US006386600B1

(12) United States Patent
Kalsi

(10) Patent No.: US 6,386,600 B1
(45) Date of Patent: May 14, 2002

(54) VEHICLE DOOR LATCH

(75) Inventor: Gurbinder Singh Kalsi, West Midlands (GB)

(73) Assignee: Meritor Light Vehicle Systems (UK) Ltd., Birmingham (GB)

( * ) Notice: Subject to any disclaimer, the term of this patent is extended or adjusted under 35 U.S.C. 154(b) by 0 days.

(21) Appl. No.: 09/600,005

(22) PCT Filed: Jan. 14, 1999

(86) PCT No.: PCT/GB99/00116

§ 371 Date: Aug. 7, 2000

§ 102(e) Date: Aug. 7, 2000

(87) PCT Pub. No.: WO99/36650

PCT Pub. Date: Jul. 22, 1999

(30) Foreign Application Priority Data

Jan. 14, 1998 (GB) ..... 9800628

(51) Int. Cl.[7] ..... E05C 3/06
(52) U.S. Cl. ..... 292/216; 292/201
(58) Field of Search ..... 292/216, 201, 292/DIG. 23, DIG. 25

(56) References Cited

U.S. PATENT DOCUMENTS 5,078,436 A * 1/1992 Kleefeldt et al. ..... 292/201
5,288,115 A * 2/1994 Inoue et al. ..... 292/201
5,474,339 A 12/1995 Johnson ..... 292/216
5,918,917 A * 7/1999 Elton et al. ..... 292/201
6,308,587 B1 * 10/2001 Shinkawa et al. ..... 74/89.25

FOREIGN PATENT DOCUMENTS

| | | |
|---|---|---|
| DE | 19501493 | 7/1996 |
| EP | 0433103 | 6/1991 |
| FR | 2746840 | 10/1997 |
| GB | 2112443 | 7/1983 |
| GB | 2142078 | 1/1985 |

* cited by examiner

*Primary Examiner*—Lynne H. Browne
*Assistant Examiner*—John B. Walsh
(74) *Attorney, Agent, or Firm*—Wood, Phillips, VanSanten, Clark & Mortimer

(57) ABSTRACT

A vehicle door latch assembly including a latch (10) operatively co-acting with a striker as the door nears its closed position, a latching pawl (16) self-engaging with the latch (10) to hold it in latched condition retaining the door, and unlatching means selectively operable to disengage the latching pawl (16) for opening the door, unlatching means comprising a pawl lifter (20) moveable from a position of rest to carry the latching pawl (16) out of engagement with the latch (10) and a power driven output member (28) selectively moveable to engage and displace the pawl lifter (20) from the position of rest. The output member (28) is a plunger (28) advanced and retracted by a drive motor (22) and is also displaceable laterally to an inactive angular position at which it does not engage with the pawl lifter, whereby, if power should fail, manual operation of the pawl lifter for unlatching will not be obstructed by the plunger.

5 Claims, 2 Drawing Sheets

VEHICLE DOOR LATCH

This invention relates to latch assemblies for vehicle doors, particularly for light passenger and goods vehicles, incorporating power actuation for latching and/or unlatching.

Power operated locking and latching of doors is becoming more favoured, both as part of central locking systems, and to enable more effective weathersealing of doors and greater freedom in styling and design. Power actuated unlatching has the advantages of dispensing with much of the mechanical linkage and components needed for conventional manual inside and outside door handles, and in providing unitary lock and latch modules of standard form which can be speedily installed in doors of a wide range of vehicle models and types without special adaptation.

The object of the invention is to provide improvements in vehicle door latch assemblies, in particular the provision of latches having a power unlatching facility in an economical, effective and reliable form.

According to the invention there is provided a vehicle door latch assembly including pivotally mounted or other latch operatively co-acting with a striker as the door nears its closed position, a latching pawl self-engaging with the latch to hold it in latched condition retaining the door, and unlatching means selectively operable to disengage the latching pawl for opening the door, said unlatching means comprising a pawl lifter moveable from a position of rest to carry the latching pawl out of engagement with the latch, and a power driven output member selectively movable to engage and displace the pawl lifter from said position of rest; characterised in that said output member is a plunger advanced and retracted by a drive motor and also displaceable laterally to an inactive angular position at which it does not engage with the pawl lifter, and in that the unlatching means further includes guide means controlling the path of movement of the plunger including a track formation on one of the plunger and a stationary part of the assembly coacting with a follower on the other of said plunger and part to cause the plunger to be displaced to said inactive position during retraction from its advanced position whereby, if power should fail during retraction, manual operation of the pawl lifter for unlatching will not be obstructed by the plunger.

Preferably the assembly further includes an over-riding formation operated independently of the plunger by manual shifting of the pawl lifter, to displace the plunger to the inactive position if power should fail during advance or at the advanced position so that said manual shifting is not blocked by the plunger when not displaced by the follower and track formation.

Figure 1:
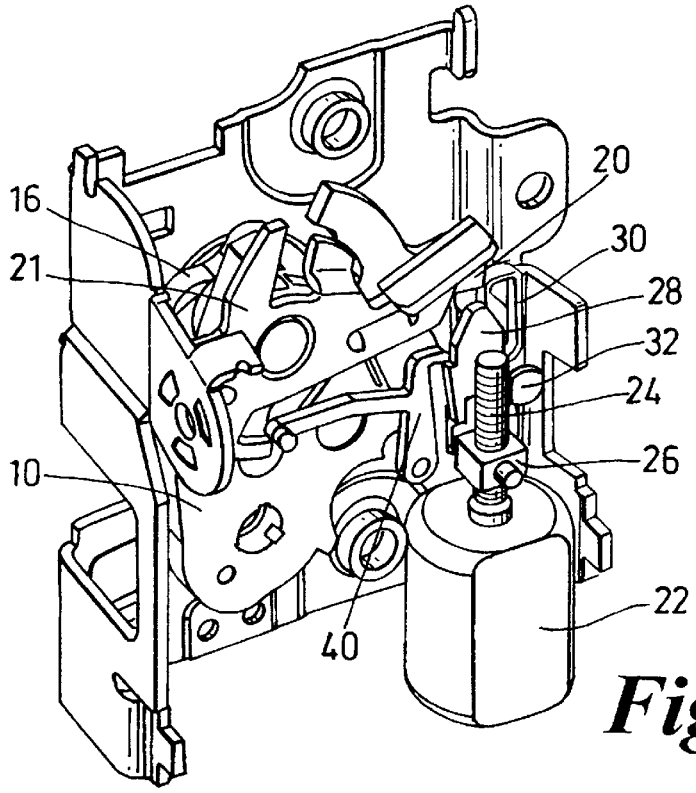
Figure 2:
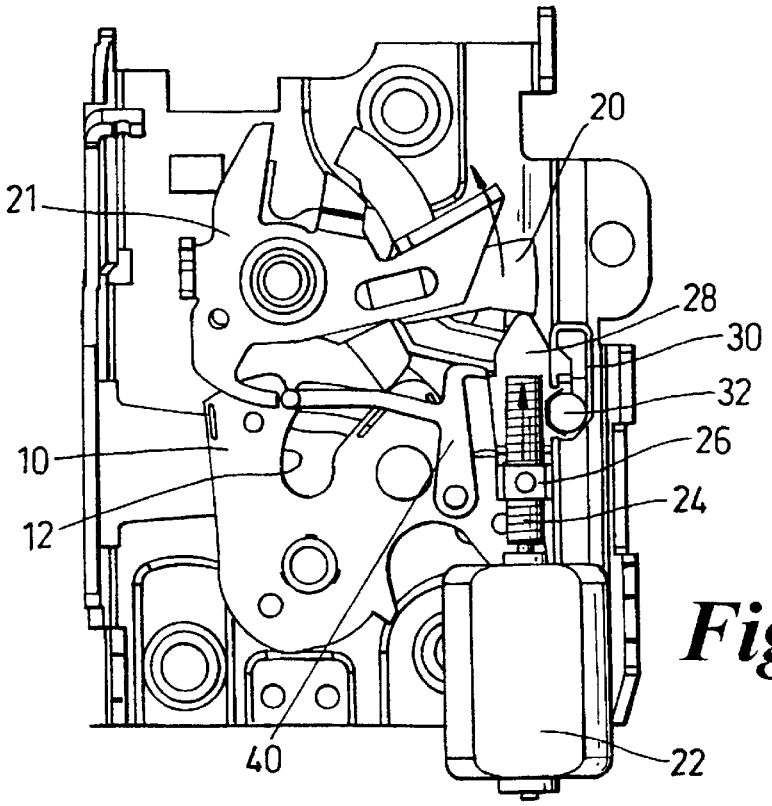
Figure 3:
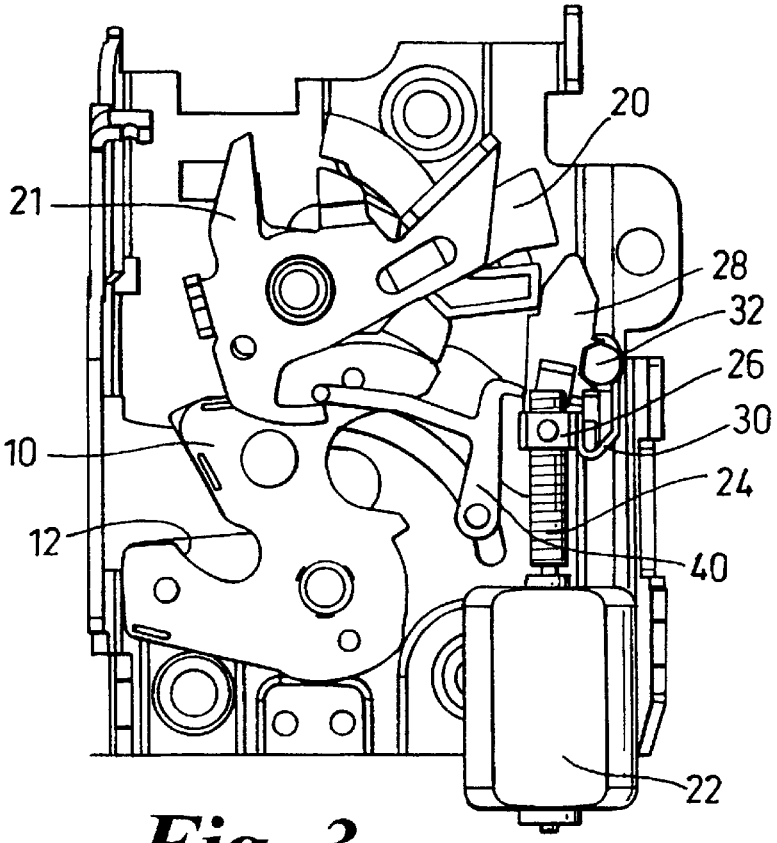
Figure 4:
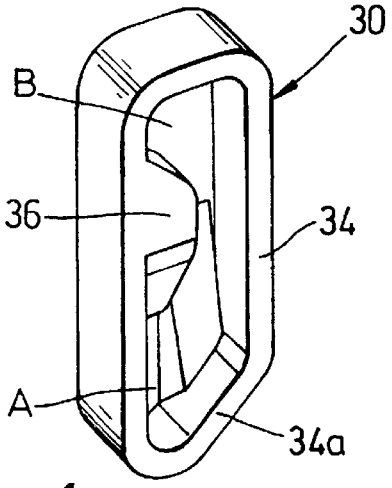

An example of the invention is now more particularly described with reference to the accompanying drawings in which:

FIG. 1 is a perspective view of a vehicle door latch assembly with some parts not relevant to the invention removed for clarity, FIG. 2 is a front elevation thereof with unlatching mechanism in a rest condition, FIG. 3 is a like elevation with said mechanism in another position, and FIG. 4 is a perspective diagram of plunger guide means of said mechanism.

Referring firstly to FIG. 1, the latch assembly, which will be operatively mounted in a door (not shown) in a known manner, includes a conventional rotating latch claw 10 having a mouth 12 for coacting with a striker (not shown) operatively mounted to the associated door post. A latching pawl 16 self engages with the claw in known manner to retain it, and hence the door, releasably at a first safety position at which the door is near closed, and an inner position shown in FIG. 2 at which the door is fully shut.

The assembly may include provision for powered closing/latching of the door, and/or for remotely controlled power actuated locking and unlocking.

Unlatching means includes a pawl lifter 20 in the form of a two armed lever pivoted co-axially with pawl 16 which engages the latter when angularly displaced from its position of rest shown in FIGS. 1 and 2 so causing disengagement of pawl 16 from claw 10 to free the door for opening. Manually operable release means includes a manual release lever 21, also pivoted co-axially with pawl 16 alongside lifter 20. Lever 21 is coupled to lifter 20 for movement of the latter when a lock link (not shown) is in unlocked condition. A manual release member of the door (not shown) e.g. a door handle, is coupled to lever 21.

Power operated unlatching means of the assembly includes an electric motor 22 operable in either direction of rotation. A worm 24 on the output shaft of the motor is engaged with a nut 26 to displace the latter in a vertical path as viewed in the drawings.

An output member in the form of a release plunger 28 is pivotedly attached at its lower end to nut 26 to be driven up and down thereby.

When plunger 28 is aligned rectilinearly with worm 24 its upper end will engage and displace an arm of pawl lifter 20 as shown in FIG. 2 when the plunger is shifted vertically from its lowermost position of rest by operation of motor 22, causing lifter 20 to release pawl 16, freeing claw 10 for opening of the door.

By reason of its pivotal attachment, plunger 28 can also be angularly displaced to an inactive position shown in FIG. 3 at which its upper end does not engage lifter 20 even at its uppermost advanced position.

The path of movement of plunger 28 is controlled by guide means including a track formation 30 shown in detail in FIG. 4 carried on a base plate or other stationary part of the assembly and coacting with a follower 32 on a median part of plunger 28. Follower 32 comprises a tubular housing locating a follower pin (not shown) resiliently urged by a spring into engagement with track formation 30 on an axis parallel to but spaced from the pivot axis of plunger 28.

Referring to FIG. 4 track formation 30 has a peripheral guide wall 34 and, within the hollow recess framed by that wall, a caming ramp 36 half way along the left hand wall section as viewed in the drawing. The lower face of ramp 36 is angled upwardly outwards of the recess and its upper face is angled downwardly and to the right. The remaining right hand face of the ramp is vertical.

The bottom section 34*a* of the guide wall is angled to slope downwardly and to the left.

When plunger 28 is at its lowermost position of rest (FIG. 1) the pin of follower 32 is in the lower most corner of the track recess at position A FIG. 4. When plunger 28 is driven upwards the spring loaded follower pin rides up the lower angled face of ramp 36 and across it until it snaps back into the recess at the upper left hand corner position B.

On the return stroke, by reversal of motor 22, the angled upper face of ramp 36 coacts with the follower pin to angularly displace plunger 28 to the right through the major part of its return stroke, restoring it to rectilinear alignment to return to position A only as the pin coacts with the angled lower wall section 34*a*.

The displacement of plunger 28 to this inactive condition during the return stroke ensures that the plunger cannot block free movement of the pawl lifter 20 if power should fail during retraction of the plunger, leaving lifter 20 free to be operated manually by release lever 21 so that latching and unlatching of the door is not prevented.

There is also the possibility that power might fail during the upward advanced stroke of plunger 28 or while it is at its uppermost position which would again obstruct latching and unlatching manually. Further provision is made for over-riding the powered operation comprising an over-riding lever 40 pivotedly mounted to the left of plunger 28, a leftwardly extending arm of lever 40 being engaged by a formation of the release lever 21 so that a second arm of lever 40 abuts the side of plunger 28 to move it angularly to the right clear of pawl lifter 20. It will be seen that track formation 30 is so shaped that there is no obstruction to this angular displacement at any part of the vertical path of movement of the pin of follower 32 from A to B.

The arrangement described provides power actuated unlatching in a simple and reliable way with few additional components and compact construction facilitating its incorporation into standard latch and locking assemblies, and with fail safe operation in that manual over-ride of the power actuation mechanism is possible and certain under all conditions and if power should fail at any time during the operating cycle, for example if the battery of the vehicle should go flat, a fuse should have blown, or due to any other electrical failure.

It will be understood that variations may be made in the above described embodiment, for example for some applications other forms of power drive might be employed, eg a rack and pinion arrangement, instead of the described worm and nut. The arrangement of the guide means may also be varied, for example a track formation could be provided on the release plunger 28 coacting with a resiliently loaded or other follower at a fixed location.

What is claimed is:

1. A vehicle door latch assembly including a latch operatively co-acting with a striker as a vehicle door nears a closed position, a latching pawl self-engaging with the latch to hold it in latched condition retaining the door, and unlatching means selectively operable to disengage the latching pawl for opening the door, said unlatching means comprising a pawl lifter moveable from a position of rest to carry the latching pawl out of engagement with the latch and a power driven output member selectively moveable to engage and displace the pawl lifter from said position of rest; characterised in that said output member is a plunder advanced and retracted by a drive motor and also displaceable laterally to an inactive angular position at which it does not engage with the pawl lifter, and in that the unlatching means further includes guide means controlling the path of movement of the plunger including a track formation on one of the plunger and a stationary part of the assembly coacting with a follower on the other of said plunger and said stationary part to cause the plunger to be displaced to said inactive position during retraction from an advanced position whereby, if power should fail during retraction, manual operation of the pawl lifter for unlatching will not be obstructed by the plunger.

2. An assembly as in claim 1 further including an over-riding formation operated independently of the plunger by manual shifting of the pawl lifter to displace the plunger to the inactive position if power should fail during advance or at the advanced position so that said manual shifting is not blocked by the plunger when not displaced by the follower and track formation.

3. An assembly as in claim 1 characterised in that the motor drives a worm engaging a nut for advance and retraction, the plunger being pivotally connected to the nut for lateral displacement.

4. An assembly as in claim 1, characterised in that the follower includes a pin resiliently urged into engagement with the track, the track having a camming ramp shaped so that the pin rides over it as the plunger is advanced to engage the pawl lifter but is tracked alongside the ramp to laterally displace the plunger on retraction.

5. An assembly as in claim 4 characterised in that the track includes a section, engaging the pin to return the plunger from the inactive position as it reaches full retraction.

* * * * *